US009555645B1

(12) United States Patent
Mealy et al.

(10) Patent No.: US 9,555,645 B1
(45) Date of Patent: Jan. 31, 2017

(54) CONTROLLING A PLURALITY OF NOZZLES OF A HANDHELD PRINTER

(75) Inventors: James Mealy, Corvallis, OR (US); Asher Simmons, Corvallis, OR (US)

(73) Assignee: Marvell International Ltd., Hamilton (BM)

( * ) Notice: Subject to any disclaimer, the term of this patent is extended or adjusted under 35 U.S.C. 154(b) by 1803 days.

(21) Appl. No.: 12/188,056

(22) Filed: Aug. 7, 2008

Related U.S. Application Data

(60) Provisional application No. 60/954,463, filed on Aug. 7, 2007.

(51) Int. Cl.
*B41J 3/36* (2006.01)
*B41J 3/39* (2006.01)

(52) U.S. Cl.
CPC .... *B41J 3/36* (2013.01); *B41J 3/39* (2013.01)

(58) Field of Classification Search
CPC ..... B41J 3/36
See application file for complete search history.

(56) References Cited

U.S. PATENT DOCUMENTS

| | | | |
|---|---|---|---|
| 5,278,582 | A | 1/1994 | Hongo |
| 5,387,976 | A | 2/1995 | Lesniak |
| 5,461,680 | A | 10/1995 | Davis |
| 5,578,813 | A | 11/1996 | Allen et al. |
| 5,927,872 | A | 7/1999 | Yamada |
| 5,930,466 | A | 7/1999 | Rademacher |
| 5,988,900 | A | 11/1999 | Bobry |
| 6,348,978 | B1 | 2/2002 | Blumer et al. |

(Continued)

FOREIGN PATENT DOCUMENTS

| | | | |
|---|---|---|---|
| EP | 1209574 | A2 | 5/2002 |
| JP | 2002307756 | A | 10/2002 |
| JP | 2006341604 | A | 12/2006 |

OTHER PUBLICATIONS

U.S. Appl. No. 11/955,209, filed Dec. 12, 2007, Bledsoe et al.

(Continued)

*Primary Examiner* — Alessandro Amari
*Assistant Examiner* — Kendrick Liu

(57) ABSTRACT

Apparatuses and methods for locating and retrieving image data from a memory and to subsequently control nozzles of a handheld printer during a printing operation are described herein. The novel methods may include initially determining an index location of an index nozzle of a printer with respect to an image in physical image space, a version of the image being stored in a memory, and the printer having a plurality of nozzles including the index nozzle. Then, based at least in part on the determined index location, the novel methods may include calculating one or more secondary locations with respect to the image in the physical image space of one or more secondary nozzles of the plurality of nozzles. Data stored at corresponding locations of the memory may then be read based at least in part on the index and secondary locations in physical image space, the corresponding locations of the memory being associated with the index and secondary locations in physical image space. And, finally, the novel methods may include controlling the nozzles based at least in part on the reading of data at the corresponding locations of the memory to form at least a first portion of the image on a print medium.

14 Claims, 7 Drawing Sheets

(56) References Cited

U.S. PATENT DOCUMENTS

| | | | | |
|---|---|---|---|---|
| 6,384,921 | B1 | 5/2002 | Saijo et al. | |
| 7,038,712 | B1 | 5/2006 | Livingston et al. | |
| 7,200,560 | B2 | 4/2007 | Philbert | |
| 7,297,912 | B1 | 11/2007 | Todoroff et al. | |
| 7,410,100 | B2 | 8/2008 | Muramatsu | |
| 7,607,749 | B2 | 10/2009 | Tabata et al. | |
| 7,929,019 | B2 | 4/2011 | Ohmura et al. | |
| 7,949,370 | B1 | 5/2011 | Bledsoe et al. | |
| 7,988,251 | B2 | 8/2011 | Dimitrijevic et al. | |
| 2002/0154186 | A1 | 10/2002 | Matsumoto | |
| 2002/0158955 | A1 | 10/2002 | Hess et al. | |
| 2003/0150917 | A1 | 8/2003 | Tsikos et al. | |
| 2004/0021912 | A1 | 2/2004 | Tecu et al. | |
| 2004/0109034 | A1 | 6/2004 | Brouhon | |
| 2004/0208346 | A1 | 10/2004 | Baharav et al. | |
| 2005/0001867 | A1 | 1/2005 | Akase | |
| 2006/0012660 | A1 | 1/2006 | Dagborn | |
| 2006/0061647 | A1* | 3/2006 | Breton | 347/109 |
| 2007/0150194 | A1 | 6/2007 | Chirikov | |
| 2008/0007762 | A1 | 1/2008 | Robertson et al. | |
| 2008/0144053 | A1 | 6/2008 | Gudan et al. | |
| 2008/0212120 | A1 | 9/2008 | Mealy et al. | |
| 2009/0034018 | A1 | 2/2009 | Lapstun et al. | |
| 2009/0279148 | A1 | 11/2009 | Lapstun et al. | |
| 2010/0039669 | A1 | 2/2010 | Chang et al. | |
| 2010/0231633 | A1 | 9/2010 | Lapstun et al. | |

OTHER PUBLICATIONS

U.S. Appl. No. 11/955,228, filed Dec. 12, 2007, Bledsoe et al.
U.S. Appl. No. 11/955,240, filed Dec. 12, 2007, Bledsoe et al.
U.S. Appl. No. 11/955,258, filed Dec. 12, 2007, Simmons et al.
U.S. Appl. No. 11/959,027, filed Dec. 18, 2007, Simmons et al.
U.S. Appl. No. 11/968,528, filed Jan. 2, 2008, Simmons et al.
U.S. Appl. No. 11/972,462, filed Jan. 10, 2008, Simmons et al.
U.S. Appl. No. 12/013,313, filed Jan. 11, 2008, Bledsoe et al.
U.S. Appl. No. 12/016,833, filed Jan. 18, 2008, Simmons et al.
U.S. Appl. No. 12/036,996, filed Feb. 25, 2008, Bledsoe et al.
U.S. Appl. No. 12/037,029, filed Feb. 25, 2008, Bledsoe et al.
U.S. Appl. No. 12/037,043, filed Feb. 25, 2008, Bledsoe et al.
U.S. Appl. No. 12/038,660, filed Feb. 27, 2008, McKinley et al.
U.S. Appl. No. 12/041,496, filed Mar. 8, 2008, Mealy et al.
U.S. Appl. No. 12/041,535, filed Mar. 3, 2008, Mealy et al.
U.S. Appl. No. 12/041,515, filed Mar. 3, 2008, Mealy et al.
U.S. Appl. No. 12/062,472, filed Apr. 3, 2008, McKinley et al.
Fairchild, "IEEE 1284 Interface Design Solutions", Jul. 1999, Fairchild Semiconductor, AN-5010, 10 pages.
Texas Instruments, "Program and Data Memory Controller", Sep. 2004, SPRU577A, 115 pages.
Drzymala et al., "A Feasibilty Study Using a Stereo-optical Camera System to Verify Gamma Knife Treatment Specifications", Proceedings of the 22nd annual EMBS International Conference, Jul. 23-28, 2000, Chicago, IL, 4 pages.
Liu, "Determiantion of the Point of Fixation in a Head-Fixed Coordinate System", 1998 Proceedings. Fourteenth International Conference on Pattern Recognition; vol. 1; Digital Object Identifier, Published Aug. 1998, 4 pages.

* cited by examiner

40

48

CONTROLLING A PLURALITY OF NOZZLES OF A HANDHELD PRINTER

CROSS-REFERENCES TO RELATED APPLICATIONS

The present application claims priority to U.S. Patent Application No. 60/954,463, filed Aug. 7, 2007, entitled "Architecture For A Handheld Ink Jet Printer Controller," the entire disclosure of which is hereby incorporated by reference in its entirety for all purposes.

TECHNICAL FIELD

Embodiments of the present invention relate to the field of printing and, more particularly, to printing one or more images using a handheld printing device.

BACKGROUND

Conventional printing devices rely on a mechanically operated carriage to transport a print head in a linear direction as other mechanics advance a print medium in an orthogonal direction. As the print head moves over the print medium an image may be laid down onto the print medium. Compact printers have been developed through technologies that reduce the size of the operating mechanics. However, the principles of providing relative movement between the print head and print medium remain the same as traditional printing devices. Accordingly, these mechanics limit the reduction of size of the printer as well as the material that may be used as the print medium.

Handheld printing devices have been developed that allow an operator to manipulate a handheld device over a print medium in order to print an image onto the medium. In order to print an image (an electronic or digitized version of which may be stored in memory) onto a print medium using these devices, the operator will "scan" or move the print head of the handheld printing device back and forth across the print medium. Unfortunately, these devices are challenged by the unpredictable and nonlinear movements of the device, which may be provided by the operator. That is, the variations of operator induced movements, including nonlinear movements and rotations of the device itself, make it difficult to determine the precise location of the print head with respect to the image (or the electronic version of the image stored in a memory) to be formed on the print medium. This type of positioning error may have deleterious effects of the quality of the printed image.

For example, unlike in the case of conventional printing devices, it is possible for the print head of a handheld printing device to scan over the same locations on the print medium multiple times, which may result in certain portions of the image being printed multiple times. That is, in order to create an image onto a print medium using a conventional printer, a digitized version of the image to be formed is typically stored in a memory. Based on the stored image, the print head, which typically includes multiple ink nozzles laid out in an array in the case of an ink jet printer, is moved back and forth across the print medium as the print medium is incrementally moved or rotated past the print head in order to print the image. As the print head is being moved back and forth across the print medium, the nozzles of the print head may be selectively activated based on the image data stored in memory in order to deposit ink onto the print medium. Since the print medium and the image to be printed on the print medium has a relatively simple and straightforward relationship with the print head, it is relatively simple to create print images using a conventional system. That is, because of the somewhat mechanical relationships between the print head, the digitized image stored in memory, and the print medium, it is relatively simple to compute, anytime during a print job, the location or locations of the nozzles with respect to the digitized image to be printed. Also because of this straight forward relationship between the digitized image, the print head, and the print medium, every portion of the image to be printed is visited only once during the print job, thus avoiding the double printing problems that may be encountered with handheld devices.

On the other hand, the relationship between the print head, the digitized image, and the print medium is more complex with respect to handheld printing devices since the movements of the print head (or the movements of the plurality of ink nozzles that make the print head) is typically controlled by the user and therefore, the movements may be very irregular and nonlinear. As a result, some portions of the image to be printed may be visited more than once, e.g., the print head scanning over the same locations on the print medium more than once where a portion of the image has been already printed. In order to ensure that each portion of the image is visited only once, the locations of each nozzle with respect to the image to be printed must be known throughout a print job.

The complexity of doing such calculations becomes even more daunting when taking into consideration the number of nozzles being currently incorporated in today's print head. For example, in some printers, either conventional or handheld devices, there could be hundreds, thousands, or even tens of thousands of nozzles on the print head. Thus, a handheld printer may require an enormous amount of computational power in order to determine the locations of each nozzle with respect to the image to be formed. Performing such calculations may not be practical and will likely place an enormous burden on the processing capabilities of the handheld devices and may cause the handheld device to miss or skip an image line.

SUMMARY

At least some embodiments of the present invention are based on the technical problem of providing a handheld printing device that may allow a user to print images on a print medium without significant distortions or disruptions. More specifically, there is provided, in accordance with various embodiments of the present invention, methods and apparatuses that allow handheld printing devices that have, for example, multiple ink or light nozzles, to control the nozzles during a printing operation based on the calculations of the locations of the nozzles with respect to the image being printed.

According to various embodiments, novel methods are provided that includes initially determining an index location with respect to an image in physical image space of an index nozzle of a printer and determining a rotation angle of the printer, the printer having a plurality of nozzles including said index nozzle. Then, one or more secondary locations with respect to the image in the physical image space of one or more secondary nozzles of the plurality of nozzles may be calculated based, at least in part, on the determined index location and the determined rotation angle. Finally, one or more selected nozzles of the plurality of nozzles may be activated based at least in part on the calculation of the index and secondary locations in the physical image space to form at least a portion of the image onto a print medium.

In some embodiments, an electronic version of the image may be stored in a memory and the methods may further include determining corresponding locations of the memory based, at least in part, on the index and secondary locations, in the physical image space to facilitate the activation of the one or more selected nozzles, the corresponding locations of the memory being associated with the index and secondary locations of the physical image space. For these embodiments, the determining of the corresponding locations of the memory includes mapping the determined and calculated index and secondary locations in the physical image space to the corresponding locations in the memory. The determination of the corresponding locations of the memory may also include providing memory addresses to the corresponding locations of the memory.

In some embodiments, the activation of the one or more selected nozzles may be based, at least in part, on accessing and reading memory cells located at the corresponding locations of the memory. For these embodiments, the methods may further include clearing data stored at the memory cells located at the corresponding locations of the memory following the reading of the memory cells.

In various alternative embodiments, methods are provided that includes initially determining an index location with respect to an image in physical image space of an index nozzle of a printer and determining a rotation angle of the printer, a version of the image being stored in a memory, and the printer having a plurality of nozzles including the index nozzle. Based at least in part on the determined first location and rotation angle, one or more secondary locations with respect to the image in the physical image space of one or more secondary nozzles of the plurality of nozzles may be calculated. Next, data stored at corresponding locations of the memory may be read based at least in part on the index and secondary locations in physical image space, the corresponding locations of the memory being associated with the index and secondary locations in physical image space. And finally, based at least in part on the reading of the data at the corresponding locations of the memory, controlling the nozzles to form at least a first portion of the image on a print medium.

In some embodiments, the methods may further include determining the corresponding locations of the memory based, at least in part, on the determined and calculated index and secondary locations in physical image space. For these embodiments, the reading of the data stored at the corresponding locations of the memory may be based at least in part on the determination of the corresponding locations of the memory. In some embodiments, the controlling of the nozzles may include activating one or more first selected nozzles of the plurality of nozzles based at least in part on reading of data stored at the corresponding locations of the memory. For these embodiments, the methods may include clearing data stored at the corresponding locations of the memory after the reading of the data.

In some embodiments, the methods may further include determining another index location with respect to the image in the physical image space of the index nozzle and calculating, based at least in part on the determined another index location, another one or more secondary locations with respect to the image in the physical image space of the one or more secondary nozzles of the plurality of nozzles. Data stored at another corresponding locations of the memory may then be read based at least in part on the another index and the another secondary locations in physical image space, the another corresponding locations of the memory associated with the another index and the another secondary locations in physical image space. And, finally, the nozzles may be controlled again based at least in part on said reading of data stored at the another corresponding locations of the memory to form a second portion of the image on the print medium. In some embodiments, the controlling of the nozzles again includes activating one or more second selected nozzles of the plurality of nozzles based at least in part on the reading of data stored at the another corresponding locations of the memory. For these embodiments, the index and secondary locations in the physical image space may be determined and calculated during a first time period, and the another index and the another secondary locations in the physical image space may be determined and calculated during a second time period. In some embodiments, at least one of the index and secondary locations in the physical image space that was determined and calculated for the index and secondary nozzles is the same as at least one of the another index and the another secondary locations in the physical image space determined and calculated for the index and secondary nozzles. In some embodiments, one or more nozzles of the plurality of nozzles are associated with both the at least one of the index and secondary locations of the physical image space and the at least one of the another index and the another secondary locations of the physical image space, in which case, the activating of the one or more second selected nozzles may include excluding from activation the one or more nozzles of the plurality of nozzles during the second time period.

In some embodiments the controlling of the plurality of nozzles may include activating at least one of the plurality of nozzles to discharge an ink or a light beam from the at least one of the plurality of nozzles onto a print medium.

In some embodiments, the memory may include a plurality of memory cells, and reading of the data stored at the corresponding locations of the memory includes reading data stored at selective memory cells that corresponds to the index and secondary locations in the physical image space. For these embodiments, reading of the data stored at the corresponding locations of the memory may include reading to determine whether the memory cells that corresponds to the corresponding locations in the memory includes logic 1 or logic 0 and based on the reading, to selectively activate at least a subset of the first and the second nozzles.

In various embodiments, apparatuses are provided to implement the various methods described above. For example, in some embodiments, an apparatus is provided that includes a plurality of nozzles; a memory; and a print engine coupled to the plurality of nozzles and the memory. The print engine may be configured to determine an index location with respect to an image in physical image space of an index nozzle of the plurality of nozzles, a version of the image to be stored in the memory, and to determine a rotation angle of the apparatus. The print engine may also be configured to calculate, based at least in part on the determined index location and rotation angle, one or more secondary locations with respect to the image in the physical image space of one or more secondary nozzles of the plurality of nozzles. After calculating the one or more secondary locations, the print engine may be configured to read data stored at corresponding locations of the memory based at least in part on the index and secondary locations in physical image space, said corresponding locations of the memory associated with the index and secondary locations in physical image space. The print engine may further control the nozzles based at least in part on said reading of data stored at the corresponding locations of the memory to form at least a portion of the image onto a print medium.

In some embodiments, the above described methods may also be implemented with software. For example, various embodiments provides for a computer-readable storage medium including computer readable instructions that, if executed by a computer system, cause the system to determine an index location with respect to an image in physical image space of an index nozzle of a printer, a version of the image being stored in a memory, to determine a rotation angle of the printer, to calculate, based at least in part on the determined index location and rotation angle, one or more secondary locations with respect to the image in the physical image space of one or more secondary nozzles of the plurality of nozzles, to read data stored at corresponding locations of the memory based at least in part on the index and secondary locations in physical image space, said corresponding locations of the memory associated with the index and secondary locations in physical image space, and to control the nozzles based at least in part on said reading of data stored at the corresponding locations of the memory to form at least a portion of the image onto a print medium.

These and other features of various embodiments of the present invention are described in greater detail herein.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Figure 1:
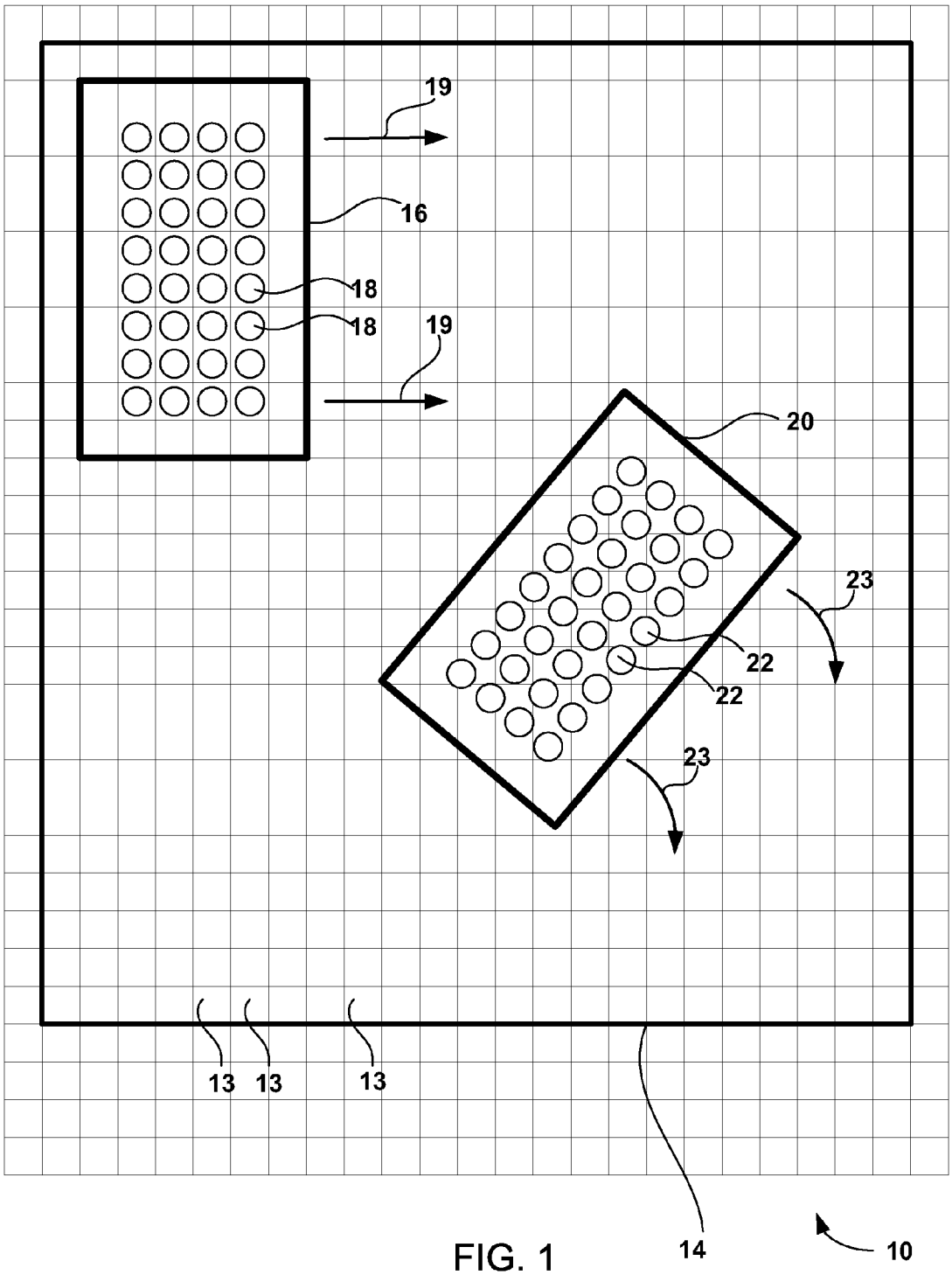
FIG. 1 schematically illustrates a grid, and outlines of print heads in a physical image space.

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Reference in the specification to "one embodiment" or "an embodiment" means that a particular feature, structure, or characteristic described in connection with the embodiment is included in at least one embodiment. The appearances of the phrase "in one embodiment" in various places in the specification do not necessarily all refer to the same embodiment, but they may.

The phrase "A and/or B" means (A), (B), or (A and B). The phrase "A, B, and/or C" means (A), (B), (C), (A and B), (A and C), (B and C) or (A, B and C). The phrase "(A) B" means (A B) or (B), that is, A is optional.

According to various embodiments of the present invention, methods and apparatuses are provided that may facilitate, for example, a handheld printer to accurately and efficiently print an image onto print medium. Embodiments of the present invention may also allow the operator the freedom to move a handheld printer in any linear or nonlinear direction with respect to the print medium during a printing operation of an image onto a print medium without causing disruptions or degradation of the image to be formed. A handheld printer may be any type of portable or mobile printer with a plurality of nozzles. Examples of such printers include, for example, handheld ink jet-printers with ink nozzles, handheld laser printers with a plurality of light beam sources such as light emitting diodes (LEDs) for illuminating a light sensitive print medium, and so forth. The terms "handheld printer," "handheld printing device," and "handheld device" may be used interchangeably throughout the following description. Thus, these terms are synonymous. Further, the terms "printing operation" and "print job" may also be used interchangeably throughout the following description and are, therefore, synonymous.

Handheld printers may include many of the same components of conventional printers. For example, just like convention printers, a handheld printer may include a print head having a large number of ink or light beam nozzles (or simply "nozzles") that may be controlled in order to print an image onto a print medium. As previously described, unlike conventional printers, however, handheld printers do not rely on mechanical means to move the print head with respect to the print medium during a print job. Instead, these devices rely on the operator's imprecise movement of the handheld device in order to move the handheld device (and the print head) over the print media during a print job.

In particular, the movement of a handheld printing device over a print medium during a printing operation may be under the physical control of an operator (i.e., operator propelled). Because of the inability for humans to make consistently precise motions, a handheld device under the physical control of the operator, may be placed in irregular, angular, and/or nonlinear motion with respect to the image to be formed on a print medium, which is unlike the clean back and forth motions of a print head in a convention printer. Even worse, because of the inability of humans to accurately track and avoid those portions of the image that have already been printed onto the print medium, some portions of the image may be inadvertently printed more than once. In order to ensure that the handheld printing device is not improperly printing an image, some sort of logic may be needed in order to be able to quickly and accurately track the movements and locations of each of the nozzles with respect to, for example, the electronic or the digitized version of the image to be printed on to a print medium that is typically stored in the printer memory.

Part of the above described problems associated with handheld printers may be due to, no doubt, the result of the difficulties of trying to locate, retrieve, and process, for each of the nozzles, the appropriate image pixel data that may be stored in memory. This may be best demonstrated by the following example with reference to FIG. 1, which schematically illustrates a grid 10 in paper space (or herein "physical image space"). The large rectangle (herein "image 14") within the grid 10 represents, for this illustration, the outer outline of an image, in physical image space, to be printed onto a print medium, the electronic version of which may be stored in a printer memory, to be printed on a print medium. Thus, in essence, image 14 represents not just the image to be printed but also the electronic version of the image stored in the printer memory.

Each block 13 in image 14 may represent an image pixel, which may be further associated with a memory cell or element in the printer memory that will store the image data for the image pixel. In the printer memory, data for each image pixel may be stored in separate memory cells or elements. Note that if the electronic form of the image stored in the printer memory is a digitized image, then logic "0" stored in a memory cell may indicate, for example, that no ink (or light beam) should be deposited by a nozzle for the corresponding image pixel while logic "1" may indicate that ink should indeed by deposited by a nozzle for the corresponding image pixel.

Superimposed on top of the grid 10 and the image 14 is an outline of a print head 16 and nozzles 18 of a conventional printer to show the location of the print head 16 and nozzles 18 with respect to the image 14 in the physical image space. Note that the number of nozzles and the sizes of the print head 16, nozzles 18, and image pixels (i.e., blocks 13) are not drawn to scale, but instead, have been drawn entirely out-of-scale for ease of illustration and understanding of various concepts.

With conventional printers, the locating, reading (or "retrieving"), and processing of image pixel data stored in memory during a print job is relatively straightforward. This is because conventional printers are typically rectilinear printer systems in which during a print job the print head 16 moves, in the physical image space, in a linear direction with respect to the image 14 as depicted by arrows 19. In particular, the mechanical systems that are typically employed in conventional printer systems will "move" the print head in a predictable linear horizontal direction with respect to the print medium and the image to be created. Between each pass of the print head, the print medium is moved, incrementally, in a vertical direction thus eventually resulting in the printing of a complete image onto a print medium. Because the movements of the print head and its nozzles are very predictable, not to mention linear with respect to the image to be formed, the locating, retrieval, and processing of image data that is stored in the printer memory is relatively easy. More particularly, the locating, retrieval, and processing of pixel data for controlling the nozzles during a printing operation that are stored in the memory elements associated with the image pixel blocks 13 is relatively straightforward and simple.

In contrast, retrieval and processing of pixel data from memory becomes significantly more complex if the print head is moving in a nonlinear and/or in an angular direction with respect to the image 14 as is the case with handheld printing devices. This is depicted in FIG. 1 by another outline of another print head 20 and nozzles 22 that is being moved in a nonlinear and in an angular manner in the physical image space with respect to the image 14 as depicted by the curved arrows 23. Because of the nonlinear movement of the print head 20 with respect to the image 14, the task of obtaining or reading pixel data from the appropriate memory elements associated with the image pixel blocks 13 for each of the nozzles 22 during a print job becomes much trickier. Further, with handheld devices where the operator controls the movement of devices (as well as the print head), it is likely that certain portions of the image 14 may be visited more than once, which may cause certain portions of the image to be printed multiple times if the earlier movements of the print head 20 and nozzles 22 with respect to the image 14 to be printed are not tracked. That is, during a printing operation, the operator may inadvertently move the handheld printer over the same locations on the print medium that was previously visited or scanned by the handheld printer. This may result in multiple printing of those revisited portions if the system does not recognize the earlier visit.

Accordingly, the present invention provides for apparatuses and methods that may facilitate a handheld printing device to quickly locate, read, and process pixel data from a printer memory in order to create an image onto a print medium with minimal distortions or disruptions. In some embodiments, this may involve calculating the locations, in physical image space, of multiple nozzles of a print head with respect to an image to be printed based on the location of an "index" nozzle in the physical image space with respect to the image. The determined locations of the nozzles in the physical image space may then be translated or mapped to memory space (or simply "memory") in order to retrieve or read the appropriate pixel data from the memory. And based on the read data, to control the nozzles during a printing operation. In some embodiments, the pixel data that was read from the memory may be cleared once the pixel data have been read in order to prevent the multiple printing problems described earlier. A "print medium," as used herein, may be any type of material having a printable surface such as a sheet of paper, a wall, a surface of a cardboard box, and so forth.

Figure 2:
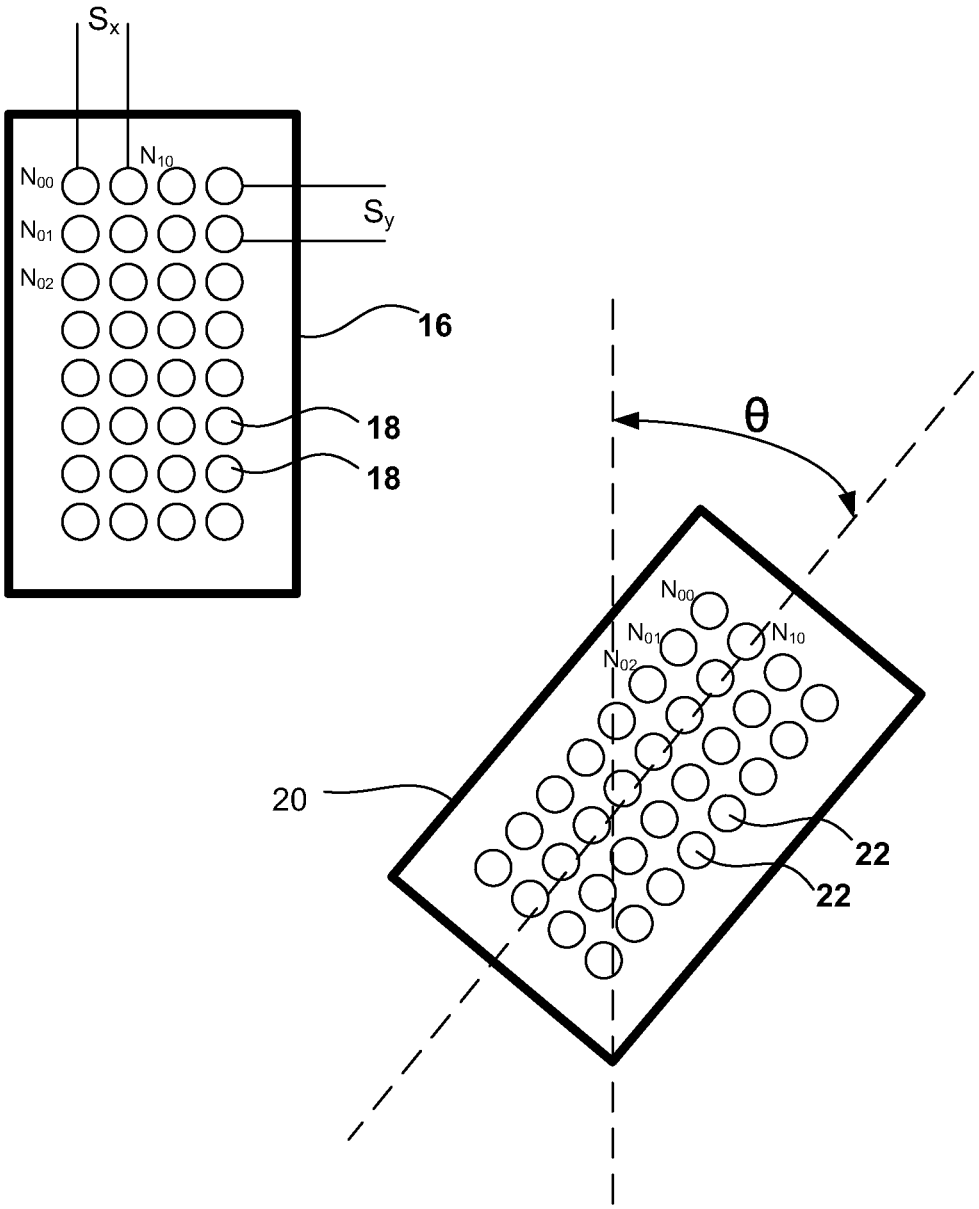
FIG. 2 schematically illustrates the print heads of FIG. 1 and selective features of the print heads.

Referring now to FIG. 2, print heads 16 and 20 of FIG. 1 are schematically illustrated without the grid 10. More particularly, FIG. 2 introduces various terms and concepts that may be useful in order to facilitate an understanding of certain aspects of various embodiments of the present invention to be described herein.

In FIG. 2 selective nozzles of print head 16 are labeled as $N_{00}$, $N_{10}$, $N_{01}$, and $N_{O2}$. Nozzles $N_{00}$, $N_{10}$, $N_{01}$, and $N_{O2}$ may be equally or unequally distanced apart. For purposes of the following description, at least one of the nozzles 16 (e.g., $N_{00}$, $N_{10}$, $N_{01}$, and $N_{O2}$) may be designated as the index nozzle. In the following description, a corner nozzle, nozzle $N_{00}$, will be the index nozzle although any of the other nozzles 18 (e.g., nozzles $N_{10}$, $N_{01}$, and $N_{02}$) may be the index nozzle in alternative embodiments. Also for purposes of this description, the other non-index nozzles may be referred to as, for a lack of a better term, "secondary" nozzles. Note that the terms "index" and "secondary" nozzles and locations, as used herein, are merely for ease of illustration and understanding and are, therefore, not to be construed as any sort of limitations unless indicated otherwise.

The distance between the index nozzle $N_{00}$ and the adjacent "horizontal" secondary nozzle $N_{10}$, which is the horizontal distance between the two nozzles, is $S_x$ (note that there is no vertical y-distance between the two in this case), while the distance between the index nozzle $N_{00}$ and the adjacent "vertical" secondary nozzle $N_{01}$, which is the vertical distance between the two nozzles, is $S_y$ (note that there is not horizontal x-distance). Note that the distance between the index nozzle $N_{00}$ and any of the other secondary nozzles 18 may also be defined in a two-dimensional (xy-coordinate) space by identifying a horizontal x-distance and a vertical y-distance. The distances (e.g., $S_x$ and/or $S_y$) between the nozzles 18 are typically predefined and are typically known. Note that the terms "vertical" and "horizontal" are used herein merely for ease of understanding and illustration and are not to be construed as any sort of limitations.

FIG. 2 also depicts the print head 20 of FIG. 1 having a rotation angle θ. As will be further described herein, by determining the location of only a single nozzle (in this case, the index nozzle $N_{00}$) with respect to the image 14 in the physical image space, the locations of the other nozzles 22 (i.e., secondary nozzles) with respect to the image 14 in the physical image space may be calculated based on the location of the index nozzle regardless of the rotation angle of the print head. Based on the calculated locations of the nozzles 22 in the physical image space, the appropriate image data stored in the memory cells may be quickly and efficiently located in the printer memory by translating the locations of the nozzles 22 in the physical image space to locations in the memory. This may be accomplished, for example, by mapping the locations of the nozzles in the physical image space to memory locations (i.e., memory cells) via memory addresses. Once the memory locations are determined, the appropriate image pixel data may be correspondingly accessed, read, and processed for each of the nozzles 22 (both the index and the secondary nozzles) in order to accurately control the nozzles 22 during a print job.

Thus, embodiments of the present invention may simplify the processing requirements for locating, retrieving, and processing image pixel data stored in a printer memory by initially determining only the location (herein "index location") of an index nozzle in a physical image space with respect to the image to be printed, and based on the index location of the index nozzle, determine the locations (herein "secondary" locations) with respect to the image, in the physical image space, of the rest of the nozzles (i.e., secondary nozzles) in order to quickly and efficiently locate and retrieve pixel data stored in the printer memory. Note that although the physical image space described herein is a two-dimensional (xy-coordinate) space, alternatively, the physical image space may be a three-dimensional space. For example, a three-dimensional space may be appropriate when the print medium is not a flat plane but rather a non-planar surface.

Figure 3:
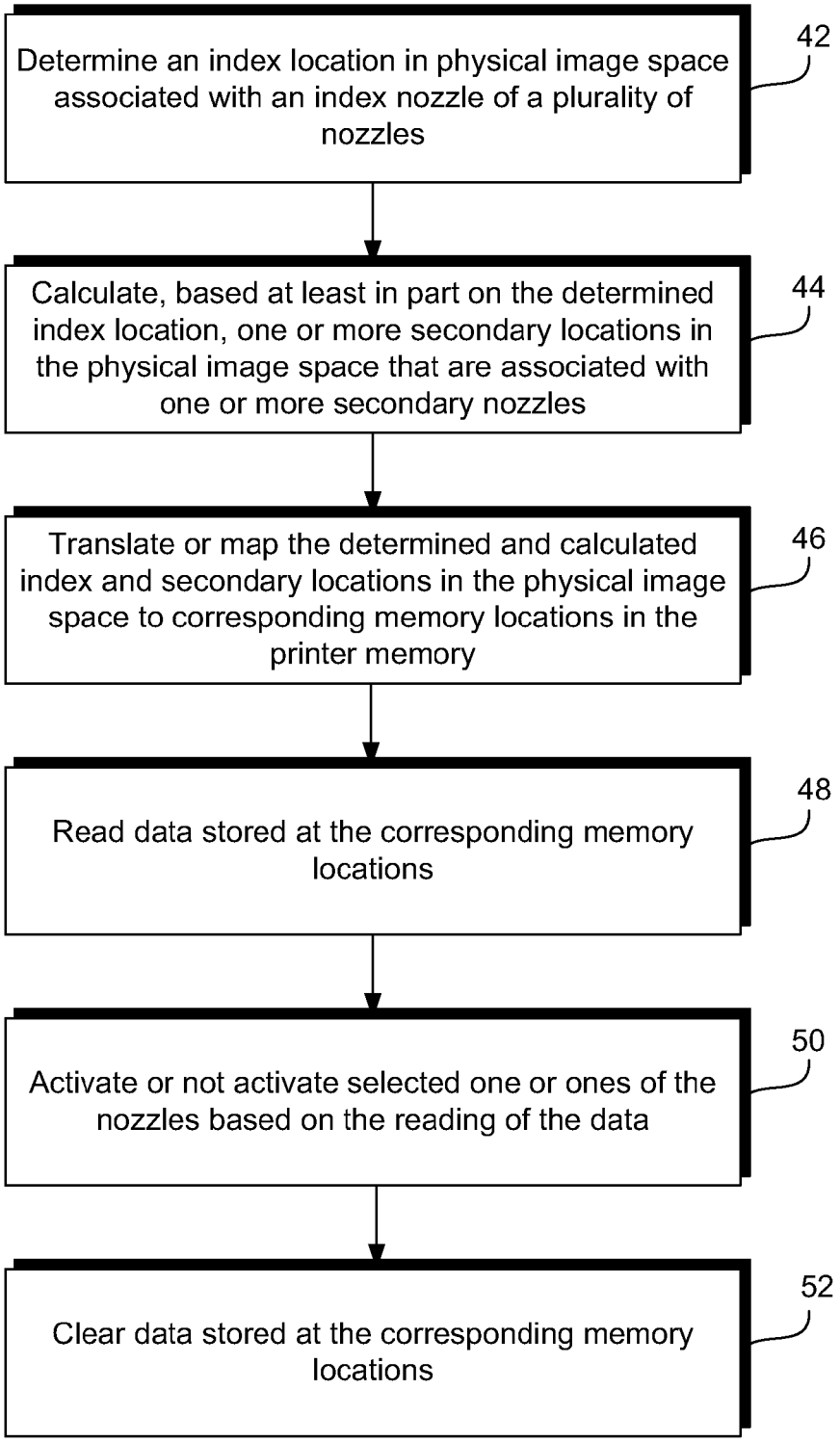
FIG. 3 is a flow diagram for controlling a plurality of nozzles of a printer, in accordance with various embodiments of the present invention.

FIG. 3 is a flow process for controlling the nozzles of a printer based on locating and reading of image data stored in a printer memory in accordance with various embodiments of the present invention. For the embodiments, the printer memory may be any type of memory used for storing electronic or digitized versions of images to be printed onto print media. The process 40 may begin when an index location in physical image space for an index nozzle (e.g., the index nozzle $N_{00}$ in FIG. 2) from the plurality of nozzles is determined with respect to an image at 42, the image being an image to be printed on to a print medium and the electronic version of the image being stored in a memory. In some embodiments, a base navigation system may be employed in order to initially calculate the index location of the index nozzle in physical image space. Other alternative means may also be employed in order to initially calculate the index location of the index nozzle. Thus, a determination of the index location of the index nozzle may be made simply by accessing or locating such data that may have already been calculated.

Next, based at least in part on the determined index location, calculating one or more secondary locations in the physical image space for one or more secondary nozzles relative to the image at 44. The process for calculating the one or more secondary locations in the physical image space for the one or more secondary nozzles (e.g., in FIG. 2, the one or more secondary nozzles being the nozzles depicted in FIG. 2 except for the index nozzle $N_{00}$) may be an iterative process.

For example, referring back to FIG. 2, once the index location in the physical image space for the index nozzle ($N_{00}$) has been determined, which may be represented by x and y coordinates, the secondary locations of the other nozzles (i.e., secondary nozzles) may be iteratively calculated one by one based on the initial determination of the index location in the physical image space of the index nozzle and using well known geometric relationships and formulas. For instance, after the index location of the index nozzle $N_{00}$ has been determined, the following equations may be used in order to determine the secondary locations of, for example, any of the adjacent secondary nozzles. A secondary location of a secondary nozzle that is adjacent to the index nozzle $N_{00}$ in the x-direction, e.g., $N_{10}$ may be determined by:

$$X=X_{start}(S_x*\text{Cos }\theta),Y=Y_{start}(S_x*\text{Sin }\theta);$$

and a secondary location of a secondary nozzle that is adjacent in the y-direction, e.g., $N_{01}$, may be determined by:

$$X=X_{start}+(S_y*\text{Sin }\theta),Y=Y_{start+}(S_y*\text{Cos }\theta);$$

where X and Y is the secondary location of the adjacent secondary nozzle in a two-dimensional Cartesian coordinate system, $X_{start}$ and $Y_{start}$, is the location in the Cartesian coordinate system for the starting nozzle, in this case the index nozzle $N_{00}$, $S_x$ and $S_y$ are the x and y distances between the starting nozzle and the adjacent nozzle, and θ is the rotation angle of the print head. θ may be determined with respect to the image, e.g., as an angle between the y-orientation of the image and the y-orientation of the print head and/or with respect to an initial location of the print head, e.g., as an angle between initial y-orientation and current y-orientation. It may be noted that, when the orientation of the image in physical image space is defined by the initial location of the print head, as described below, θ may be determined with respect to both the image and the initial location.

In order to determine the secondary location of another secondary nozzle, such as secondary nozzle $N_{O2}$, which is not adjacent to the index nozzle $N_{00}$, the above equations may again be used for calculating the secondary location of the secondary nozzle $N_{O2}$ except that the starting nozzle in this case would be, for example, secondary nozzle $N_{01}$ instead of the index nozzle $N_{00}$. Thus, the values for $X_{start}$ and $Y_{start}$ above equations would be equal to the X and Y values previously determined for secondary nozzle $N_{01}$ based on the index nozzle $N_{00}$ being the starting nozzle. This may be repeated over and over again to determine the locations of each of the nozzles with respect to the image in the physical image space.

The determined index location for the index nozzle and the calculated secondary locations for the secondary nozzles in the physical image space may then be translated or mapped to corresponding memory locations in the printer memory at 46.

Data (e.g., image or pixel data) stored at the corresponding locations in the memory may then be read at 48. Based on the reading of the data, the nozzles may be controlled by activating or not activating one or more selected nozzles in order to print or form at least a portion of the image onto a print medium at 50. If the nozzles are ink nozzles then the activation of the nozzles may result in the disposition of ink onto the print medium. On the other hand, if the nozzles are laser diodes, for example, then the activation of the nozzles may result in the projection of light beams onto the print medium. Finally, the image data stored at the corresponding memory locations may be cleared to ensure that the image data that was stored in the corresponding memory locations are not revisited again, which would cause portions of the image to be reprinted. That is, by clearing the image data that have been read, multiple printing of portions of the image may be avoided if one or more of the nozzles revisits the same locations in the physical image space (e.g., due to the operator going over or "scanning" over the same locations on the print medium).

Note that in some alternative embodiments block 52 may be executed prior to block 50 so long as block 52 is executed after block 48 (i.e., reading of the data in the first and second memory locations). The process 40 may be repeated over and over again during a printing operation as the handheld printer is moving across the print medium in a linear, non-linear, rectilinear, and/or angular manner with respect to the image. In some embodiments, the process 40 may be executed continuously, periodically, semi-periodically, and/or randomly during a printing operation.

Figure 4:
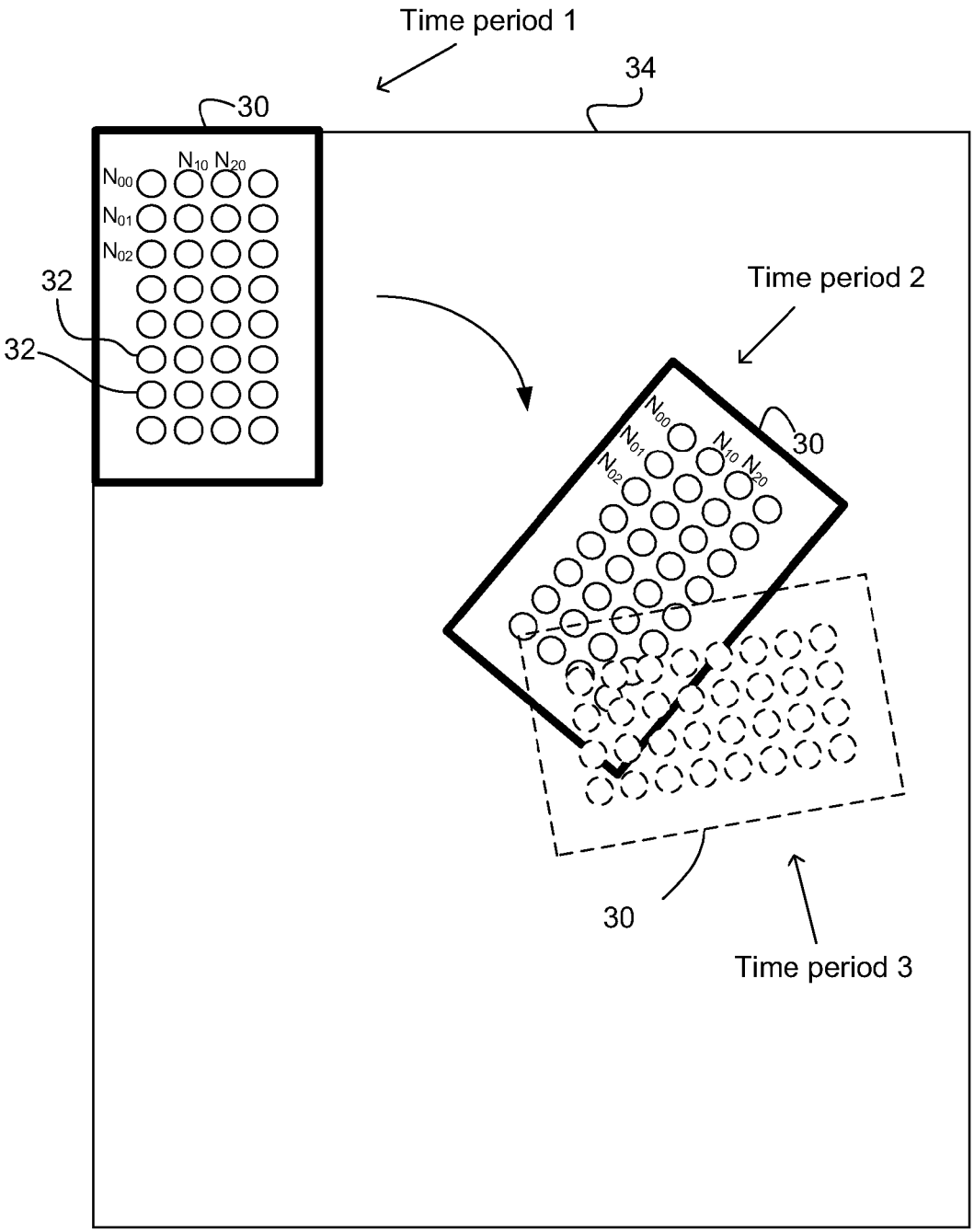
FIG. 4 illustrates movement of an exemplary print head in physical image space during a printing operation, in accordance with various embodiments of the present invention.

As an illustrative example of how the above described processes may be employed during a printing operation for printing an image onto a print medium using a handheld printer, the following example is provided with reference to FIG. 4. In particular, FIG. 4 illustrates the locations of a print head during a printing operation of an image with respect to the image in physical image space during different periods in time of the printing operation in accordance with various embodiments of the present invention.

In this example, the print head 30 and its nozzles 32, which may actually be located at an arbitrary location on the print medium, are initially located at a corner of the image 34 in the physical image space during the first time period. This initial position of the print head 30 during the first time period may "anchor" the image 34 in the physical image plane as well as anchor the image onto the print medium. That is, the initial location of the print head 30, which in this case corresponds to the top left corner of the image 34, defines how the entire image 34 should be oriented in the physical image space as well as on the print medium. As a result, the initial location of the print head 30 in the physical image space may dictate as to whether subsequent positions of the print head 30 during subsequent time periods are angularly displaced with respect to the image. Note that in some embodiments, a navigation system that includes an optical system such as those associated with a computer mouse may be employed in order to track the subsequent locations and orientations of the print head 30 (and at least the index nozzle) with respect to the initial anchor location.

During the first time period, the location of the index nozzle (e.g., nozzle $N_{00}$) with respect to the image 34 may be determined. The secondary locations of the other nozzles 32 (i.e., secondary nozzles) with respect to the image 34 may then be calculated based on the determined index location of the index nozzle and employing the iterative process described earlier. Based on the determined locations of the nozzles in the physical image space, the appropriate image data can then be located in the memory. The image data may then be retrieved and processed in order to selectively control the nozzles to print a portion of the image onto the print medium during the first time period. The locations in the memory that corresponds to the locations of the nozzles 32 in the physical image space may then be cleared to ensure that no revisits of the image data that have already been read occur.

In the second time period, the print head 30 has been moved to a new location with respect to the image 34 in the physical image space. The new location is angularly displaced with respect to the image 34 as well as with respect to the initial location of the print head 30 during first time period. The new locations of the nozzles 32 with respect to the image 34 may again be computed using the previously described process. Based on the determined new (index and secondary) locations of the nozzles 32, corresponding locations in the memory may be identified and the appropriate image data stored at those identified memory locations may be read and processed to control the nozzles in order to print another portion of the image onto the print medium. The image data stored at those memory locations may then be cleared to ensure no revisits.

In the third time period, the print head 30 has again been moved with respect to the image as well as with respect to the print medium, but this time, at least some of the nozzles 32 are at locations that have already been visited by nozzles 32 during the second time period. This will be determined during the determination and calculations of the index and secondary locations of the nozzles during the third time period. However, no reprinting of portions of the image will occur because the memory locations that correspond to the locations in the physical image space that is being revisited by the nozzles 32 were cleared during the second time period. As a result, the nozzles 32 that are revisiting those previously visited locations in the physical image space will be excluded from being activated during the third time period due to the cleared corresponding memory locations.

Figure 5:
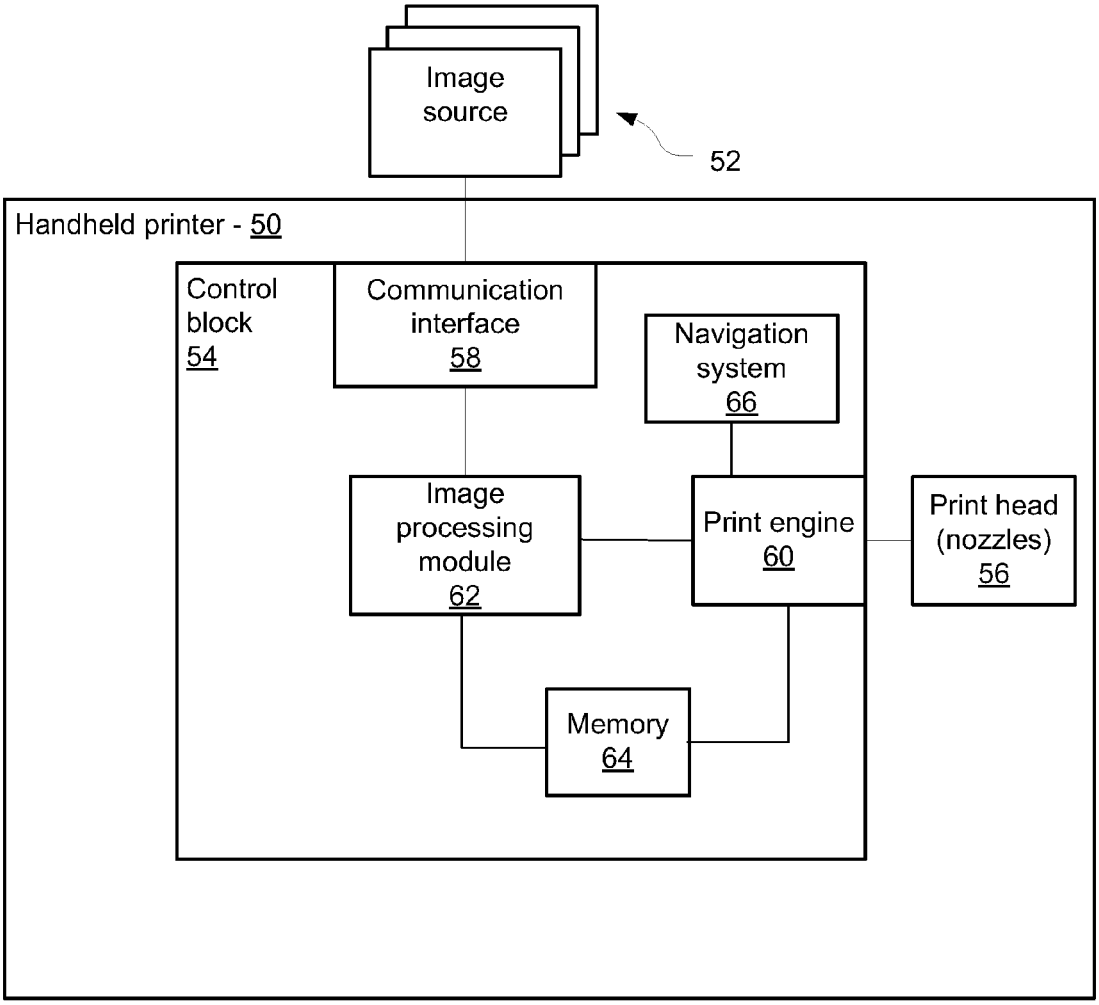
FIG. 5 is a schematic of a system including a handheld printing device, in accordance with various embodiments of the present invention.

FIG. 5 is a block diagram of a printer system including a handheld printer in accordance with various embodiments of the present invention. As depicted, the printer system 48 includes the handheld printer 50 that is either wired or wirelessly coupled to an image source 52. The image source 52 may be any type of source that provides image data including a general purpose computing device, e.g., a desktop computing device, a laptop computing device, a mobile computing device, a personal digital assistant, a cellular phone, etc., or it may be a removable storage device, e.g., a flash memory data storage device, designed to store data such as image data.

The handheld printer 50 may include a control block 54 that is coupled to a print head 56 with a plurality of nozzles. The control block 54 includes a communication interface 58, a print engine 60, an image processing module 62, a memory 64, and a navigation system 66. If the image source 52 is a removable storage device, e.g., a universal serial bus (USB) storage device, the communication interface 58 may include a port, e.g., USB port, designed to receive the storage device. The image processing module 62 may process image data received through the communication interface using various processing techniques including, for example, dithering, decompression, half-toning, color plane separation, and/or image storage. The image data processed by the image processing module 62 may be stored in the memory 64, to be subsequently accessed by the print engine 60 for controlling the nozzles included in the print head 56 during a printing operation. The control block 54 may further include a navigation system 66 to determine the location of, for example, an index nozzle, as well as the rotation angle of the print head 56.

Based on the location information of the index nozzle and the rotation angle that may be provided by the navigation system 66, the print engine 60 may calculate the locations of the nozzles (e.g., other than the index nozzles) with respect to the image in physical image space, and to efficiently locate and retrieve image data from the memory 64 based, at least in part, on the determined and calculated locations of the index nozzle and the other non-index nozzles. This may be accomplished, in some embodiments, by the print engine translating or mapping the determined and calculated locations of the nozzles to corresponding memory locations in memory 64. After determining the corresponding memory locations, the print engine may read the image data stored at the determined corresponding memory locations. After reading the image data, the image data that was read may be cleared by the print engine 60 from the memory 64. Based on the image data read from the memory 64, the print engine may control the nozzles included in the print head 56 to selectively activate or not active the nozzles.

In some embodiments, the print engine 60 may be embodied in software. For these embodiments, computer readable instructions that may be stored in a computer-readable storage medium may be executed by, for example, a processor, in order to perform the various processes described herein. In some embodiments, the print engine 60 may be embodied in hardware, e.g., application specific integrated circuit (ASIC) or system on chip (SOC), while in other alternative embodiments, the print engine 60 may be embodied in both software and hardware.

Figure 6:
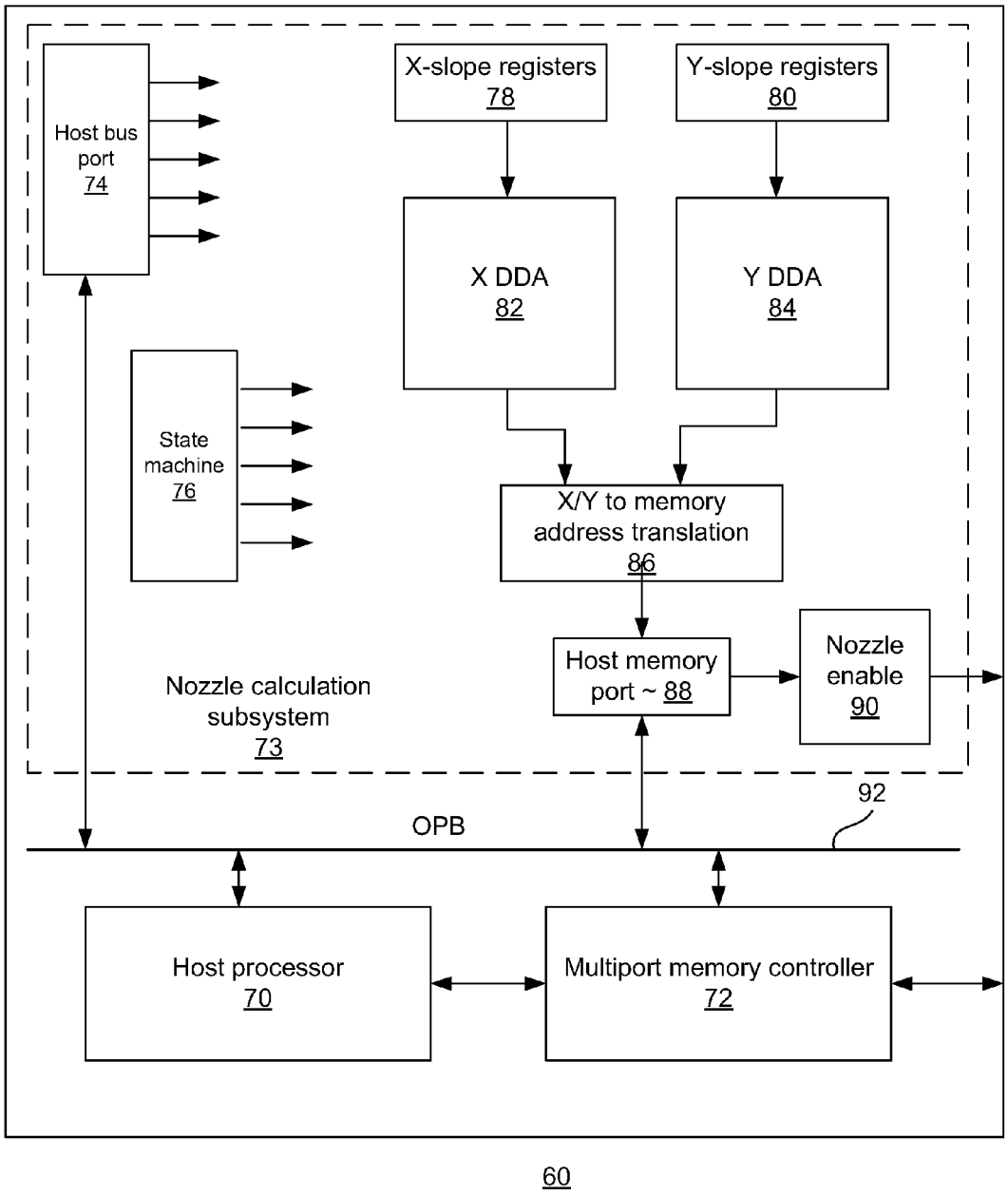
FIG. 6 is a block diagram of selective components of the print engine of FIG. 5, in accordance with various embodiments of the present invention.

Turning now to FIG. 6, which is a block diagram of selective components of a hardware implementation of print engine 60 of FIG. 5, in accordance with various embodiments. In some embodiments, the print engine may be a system on chip (SOC) integrated on a single chip or residing in a common chip package. As illustrated, print engine 60 includes a host processor 70, multiport memory controller 72, an on-chip peripheral bus (OBB) 92, and a nozzle calculation subsystem 73 that includes a host bus port 74, a state machine 76, x-slope registers 78, y-slope registers 80, an "X" digital differential analyzer (DDA) 82, an "Y" digital differential analyzer (DDA) 84, an x/y to memory address translation block 86, a host memory port 88, and a nozzle enable block 90.

Figure 7:
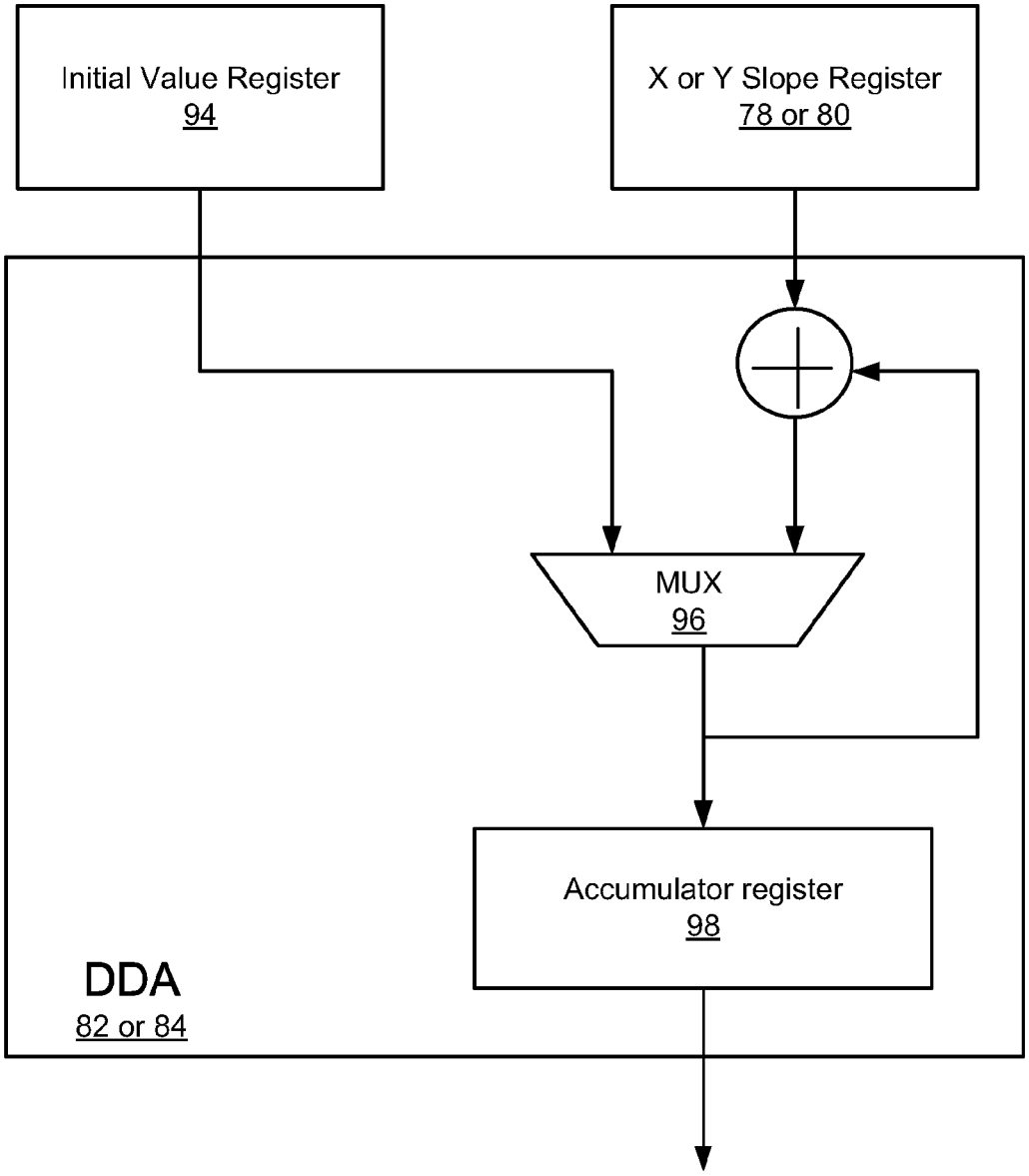
FIG. 7 is block diagram of one of the digital differential analyzer (DDA) of FIG. 6, in accordance with various embodiments of the present invention.

One of the primary components for the iterative process for calculating the locations of the printer nozzles in the physical image space described previously are the X DDA 82 and the Y DDA 84. The DDAs 82 or 84, in some embodiments, may be employed in order to accumulate the x or y coordinate values of the locations of the nozzles that are calculated using the previously described processes. FIG. 7 illustrates one of the DDAs (either the X DDA 82 or Y DDA 84), in further detail, in accordance with various embodiments. As depicted, the DDA (either X DDA 82 or Y DDA 84) is coupled to an initial value register 94 and a slope register (either the X or the Y slope register 78 or 80 of FIG. 6). The initial value register 94 may provide to the DDA 82 or 84 the x or the y coordinate values for, for example, an index nozzle (e.g., nozzle $N_{00}$ in FIG. 2) in the physical image space. Meanwhile, the slope register 78 or 80 may provide to the DDA 82 or 84, the incremental distance, in terms of an x-coordinate distance or an y-coordinate distance, between nozzles. For example, in FIG. 2 these distances could be the distance in the physical image space between adjacent nozzles $N_{00}$ and $N_{10}$ (i.e., $S_x$, which is an x-coordinate distance), the distance between adjacent nozzles $N_{00}$ and $N_{01}$ (i.e., $S_y$, which is an y-coordinate distance), and the distance between $N_{01}$ and $N_{02}$ (another y-coordinate distance).

The DDA 82 or 84, as depicted, includes a multiplexor (MUX) 96 and an accumulator register 98. The DDA 82 or 84 is an integrator, or in digital terms, an accumulator, of the fixed slope values. Thus, the DDA 82 or 84 may be used iteratively to calculate the locations, in physical image space, of each of the nozzles of a handheld printer with respect to an image to be printed onto a print medium. The host processor 70 may facilitate the calculating of the locations of the nozzles in physical image space, the reading of image data from the memory, and the subsequent control of the nozzles as described previously.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

What is claimed is:

1. A method of printing, via a handheld printer, an image onto a print medium, wherein an electronic version of the image is stored in a memory, the method comprising:

determining a first index location, with respect to the image in physical image space, of an index nozzle of the handheld printer, wherein the handheld printer comprises a plurality of nozzles including (i) the index nozzle and (ii) a plurality of secondary nozzles;

determining a first rotation angle of the handheld printer;

based at least in part on (i) the first index location in the physical image space of the index nozzle and (ii) the first rotation angle, calculating a first secondary location, with respect to the image in the physical image space, of a first secondary nozzle of the plurality of secondary nozzles;

based at least in part on (i) the first secondary location in the physical image space of the first secondary nozzle and (ii) the first rotation angle, calculating a second secondary location, with respect to the image in the physical image space, of a second secondary nozzle of the plurality of secondary nozzles; and based at least in part on (i) the second secondary location in the physical image space of the second secondary nozzle and (ii) the first rotation angle, calculating a third secondary location, with respect to the image in the physical image space, of a third secondary nozzle of the plurality of secondary nozzles, wherein the first secondary location in the physical image space, the second secondary location in the physical image space, and the third secondary location in the physical image space form a plurality of secondary locations in the physical image space, and wherein based at least in part on the plurality of secondary locations in the physical image space, one or more selected nozzles of the plurality of nozzles are activated to form at least a portion of the image onto the print medium.

2. The method of claim 1, wherein calculating the first secondary location in the physical image space of the first secondary nozzle further comprises:

calculating the first secondary location, with respect to the image in the physical image space, of the first secondary nozzle of the plurality of secondary nozzles by $$X=X_{start}(S_x*\text{COS }\theta),Y=Y_{start}(S_x*\text{Sin }\theta),$$

wherein (X, Y) form the first secondary location of the first secondary nozzle in a two-dimensional Cartesian coordinate system, ($X_{start}$, $Y_{start}$) are the first index location of the index nozzle in the Cartesian coordinate system, Sx is the distance in the x Cartesian coordinate system between the index nozzle and the first secondary nozzle, and θ is the determined first rotation angle of the handheld printer.

3. The method of claim 2, further comprising:

based at least in part on (i) the first index location in the physical image space and (ii) the first rotation angle, calculating a fourth secondary location, with respect to the image in the physical image space, of a fourth secondary nozzle of the plurality of secondary nozzles by $$X'=X_{start}(S'_y*\sin\theta), Y'=Y_{start}(S'_y*\cos\theta),$$

wherein (X', Y') form the fourth secondary location of the fourth secondary nozzle in a two-dimensional Cartesian coordinate system, ($X_{start}$, $Y_{start}$) are the first index location of the index nozzle in the Cartesian coordinate system, S'y is the distance in the x Cartesian coordinate system between the index nozzle and the fourth secondary nozzle, and θ is the determined first rotation angle of the handheld printer.

4. The method of claim 1, further comprising:

based at least in part on (i) the first index location in the physical image space and (ii) the plurality of secondary locations in the physical image space, determining first corresponding locations in the memory, wherein the first corresponding locations of the memory are associated with (i) the first index location in the physical image space and (ii) the plurality of secondary locations in the physical image space; and based at least in part on the first corresponding locations in the memory, first activating one or more selected nozzles of the plurality of nozzles to form at least a portion of the image onto the print medium, wherein determining the first corresponding locations of the memory comprises providing first memory addresses of the first corresponding locations in the memory, and based at least in part upon the first memory addresses, mapping (i) the first index location in the physical image space and (ii) the plurality of secondary locations in the physical image space to the first corresponding locations in the memory.

5. The method of claim 4, wherein first activating the one or more selected nozzles is based at least in part on accessing and reading memory cells located at the first corresponding locations of the memory.

6. The method of claim 4, further comprising:

subsequent to activating the one or more selected nozzles, clearing the data stored at the first corresponding locations in the memory.

7. The method of claim 4, wherein first activating one or more selected nozzles of the plurality of nozzles comprises discharging ink from the one or more selected nozzles of the plurality of nozzles onto the print medium.

8. A handheld printer comprising:

a plurality of nozzles comprising an index nozzle and a plurality of secondary nozzles;

a memory; and a print engine configured to determine a first index location, with respect to the image in physical image space, of the index nozzle, determine a first rotation angle of the handheld printer, based at least in part on (i) the first index location in the physical image space of the index nozzle and (ii) the first rotation angle, calculate a first secondary location, with respect to the image in the physical image space, of a first secondary nozzle of the plurality of secondary nozzles, based at least in part on (i) the first secondary location in the physical image space of the first secondary nozzle and (ii) the first rotation angle, calculate a second secondary location, with respect to the image in the physical image space, of a second secondary nozzle of the plurality of secondary nozzles, and based at least in part on (i) the second secondary location in the physical image space of the second secondary nozzle and (ii) the first rotation angle, calculate a third secondary location, with respect to the image in the physical image space, of a third secondary nozzle of the plurality of secondary nozzles, wherein the first secondary location in the physical image space, the second secondary location in the physical image space, and the third secondary location in the physical image space form a plurality of secondary locations in the physical image space, and wherein based at least in part on the plurality of secondary locations in the physical image space, one or more selected nozzles of the plurality of nozzles are activated to form at least a portion of the image onto the print medium.

9. The handheld printer of claim 8, wherein the print engine is further configured to calculate the first secondary location in the physical image space of the first secondary nozzle by:

$$X=X_{start}+(S_x*\mathrm{COS}\ \theta), Y=Y_{start}+(S_x*\mathrm{Sin}\ \theta),$$

wherein (X, Y) form the first secondary location of the first secondary nozzle in a two-dimensional Cartesian coordinate system, ($X_{start}$, $Y_{start}$) are the first index location of the index nozzle in the Cartesian coordinate system, Sx is the distance in the x Cartesian coordinate system between the index nozzle and the first secondary nozzle, and θ is the determined first rotation angle of the handheld printer.

10. The handheld printer of claim 8, wherein the print engine is further configured to:

based at least in part on (i) the first index location in the physical image space and (ii) the first rotation angle, calculate a fourth secondary location, with respect to the image in the physical image space, of a fourth secondary nozzle of the plurality of secondary nozzles by $$X'=X_{start}(S'_y*\sin\theta), Y'=Y_{start}(S'_y*\cos\theta),$$

wherein (X', Y') form the fourth secondary location of the fourth secondary nozzle in a two-dimensional Cartesian coordinate system, ($X_{start}$, $Y_{start}$) are the first index location of the index nozzle in the Cartesian coordinate system, S'y is the distance in the x Cartesian coordinate system between the index nozzle and the fourth secondary nozzle, and θ is the determined first rotation angle of the handheld printer.

11. The handheld printer of claim 8, wherein the print engine is further configured to:

based at least in part on (i) the first index location in the physical image space and (ii) the plurality of secondary locations in the physical image space, determine first corresponding locations in the memory, wherein the first corresponding locations of the memory are associated with (i) the first index location in the physical image space and (ii) the plurality of secondary locations in the physical image space; and based at least in part on the first corresponding locations in the memory, first activate one or more selected nozzles of the plurality of nozzles to form at least a portion of the image onto the print medium, wherein the print engine is further configured to determine the first corresponding locations in the memory by providing first memory addresses of the first corresponding locations in the memory, and based at least in part upon the first memory addresses, mapping (i) the first index location in the physical image space and (ii) the plurality of secondary locations in the physical image space to the first corresponding locations in the memory.

12. The handheld printer of claim 11, wherein first activating the one or more selected nozzles is based at least in part on accessing and reading memory cells located at the first corresponding locations of the memory.

13. The handheld printer of claim 11, wherein the print engine is further configured to:

subsequent to activating the one or more selected nozzles, clear the data stored at the first corresponding locations in the memory.

14. The handheld printer of claim 11, wherein the print engine is further configured to first activate the one or more selected nozzles of the plurality of nozzles by discharging ink from the one or more selected nozzles of the plurality of nozzles onto the print medium.

* * * * *